US009816318B2

(12) United States Patent
Johnson

(10) Patent No.: US 9,816,318 B2
(45) Date of Patent: Nov. 14, 2017

(54) POWERED LADDER FOR LARGE INDUSTRIAL VEHICLES

(71) Applicant: David A. Johnson, Duluth, MN (US)

(72) Inventor: David A. Johnson, Duluth, MN (US)

( * ) Notice: Subject to any disclaimer, the term of this patent is extended or adjusted under 35 U.S.C. 154(b) by 0 days.

(21) Appl. No.: 14/966,559

(22) Filed: Dec. 11, 2015

(65) Prior Publication Data

US 2017/0167197 A1 Jun. 15, 2017

(51) Int. Cl.
*E06C 5/04* (2006.01)
*E06C 7/18* (2006.01)

(52) U.S. Cl.
CPC ..... *E06C 5/04* (2013.01); *E06C 7/183* (2013.01)

(58) Field of Classification Search
CPC ..... B64C 1/14; B64C 1/1407; B64C 1/1415; B64C 1/1423; B64C 1/143; B60R 3/02; B60R 3/00; B60R 3/005; B60R 3/007; E02F 9/0833; E06C 5/02
See application file for complete search history.

(56) References Cited

U.S. PATENT DOCUMENTS 1,772,547 A * 8/1930 Keese ..... E02F 3/905 138/120
2,650,750 A 9/1953 Chesney et al.
2,910,255 A * 10/1959 Johnson ..... B64C 1/14 244/129.6
3,190,392 A * 6/1965 Ashton ..... A01D 41/1261 182/97
3,291,258 A 12/1966 Twilley
3,464,517 A 9/1969 Akermanis
3,563,342 A 2/1971 Lasiter
3,601,220 A 8/1971 Saucker
3,656,578 A * 4/1972 Hemken ..... A01D 41/1261 182/115

(Continued)

FOREIGN PATENT DOCUMENTS

GB 2345720 A * 7/2000 ..... E06C 1/22
JP 2003019923 1/2003

(Continued)

OTHER PUBLICATIONS

Notification of Transmittal of the International Search Report and the Written Opinion of the International Searching Authority, dated Mar. 14, 2017.

*Primary Examiner* — Katherine Mitchell
*Assistant Examiner* — Shiref Mekhaeil
(74) *Attorney, Agent, or Firm* — Nikolai & Mersereau, P.A.; Thomas J. Nikolai

(57) ABSTRACT

A ladder assembly for a work vehicle comprises a deck affixed horizontally just below an entry door of the cab. A yoke is pivotally joined to a support member of the deck for rotation about a vertical axis below the deck surface. The yoke has a pair of arms pivotally joined to an upper end of a ladder structure for allowing rotation of the ladder about a horizontal axis. A turnbuckle is coupled between the support structure of the deck and one stringer of the ladder while a mechanical actuator is operatively coupled to the ladder's other stringer and to an arm of the yoke to which the other stringer is attached. Operation of the mechanical actuator moves the ladder reciprocally between a use position and stowed position where the stowed position is parallel to and immediately below the deck.

8 Claims, 7 Drawing Sheets

(56) References Cited

U.S. PATENT DOCUMENTS 3,672,549 A * 6/1972 Chorey ..... B60R 3/005 182/127
3,774,720 A * 11/1973 Hovey ..... B63B 27/146 114/362
3,869,022 A 3/1975 Wallk
3,967,695 A 7/1976 Waddell
3,986,724 A 10/1976 Rivinius
3,989,122 A 11/1976 Jenkins
3,997,183 A 12/1976 Russey
4,021,071 A 5/1977 Norman
4,067,588 A 1/1978 Morge et al.
4,131,293 A 12/1978 Kindle
4,139,678 A 2/1979 Keller
4,199,040 A 4/1980 Lapeyre
4,217,971 A 8/1980 Rivinius
4,243,120 A 1/1981 Pratt, Jr. et al.
4,245,716 A 1/1981 Rayfield
4,333,547 A 6/1982 Johanson
4,509,617 A 4/1985 Lapeyer
4,556,128 A 12/1985 Thorley et al.
4,613,155 A * 9/1986 Greenwood ..... A01C 15/003 105/457
4,641,729 A * 2/1987 Beck ..... E06C 1/22 182/172
4,679,657 A 7/1987 Bennett et al.
4,872,529 A * 10/1989 Viets ..... E06C 7/423 182/172
4,982,974 A * 1/1991 Guidry ..... B60R 3/02 182/91
5,033,582 A 7/1991 Ebben
5,064,022 A 11/1991 Graham
5,064,023 A 11/1991 Loeber
5,129,168 A 7/1992 Hedley
5,163,531 A 11/1992 Whiting
5,174,411 A 12/1992 Oliver et al.
5,339,919 A 8/1994 Boyd
5,366,052 A 11/1994 Keh-Lin
5,397,143 A * 3/1995 Bird ..... B60R 3/02 280/166
5,425,615 A 6/1995 Hall et al.
5,538,100 A 7/1996 Hedley
5,617,930 A * 4/1997 Elia ..... B60R 3/02 182/166
5,624,127 A 4/1997 Arreola et al.
5,651,484 A * 7/1997 Fugman ..... B60R 9/0423 182/127
5,687,813 A 11/1997 Bensch
5,850,891 A * 12/1998 Olms ..... B60R 9/0423 182/127
5,896,946 A 4/1999 Brackett
5,939,986 A 8/1999 Schifflbauer
5,988,316 A * 11/1999 Hedley ..... B60R 3/02 182/127
6,003,633 A 12/1999 Rolson
6,029,775 A * 2/2000 Hedley ..... B60R 3/02 182/127
6,068,277 A * 5/2000 Magnussen ..... E02F 9/0833 182/127
6,209,682 B1 4/2001 Duffy et al.
6,260,455 B1 7/2001 Ferguson
6,347,686 B1 2/2002 Hedley et al.
6,672,427 B1 * 1/2004 Sheffield ..... E06C 1/22 182/165
6,739,349 B2 5/2004 Kastenschmidt
6,827,541 B1 * 12/2004 Ziaylek ..... E06C 5/02 182/127
6,981,572 B2 1/2006 Hedley
7,080,713 B1 * 7/2006 Riggs ..... B60R 3/02 182/127
8,424,642 B2 * 4/2013 Lietz ..... E06C 1/06 182/172
8,881,867 B2 * 11/2014 Takenawa ..... E02F 9/0833 182/127
8,919,497 B2 * 12/2014 Rund ..... B60R 3/02 182/127
9,447,638 B2 * 9/2016 Hedley ..... E06C 1/393
2002/0189899 A1 12/2002 Hedley et al.
2003/0173153 A1 9/2003 Hedley
2005/0263976 A1 * 12/2005 Brockway ..... E02F 9/0833 280/166
2006/0070804 A1 * 4/2006 Lapke ..... B60R 3/02 182/127
2007/0158138 A1 * 7/2007 Sheffield ..... E06C 7/423 182/172
2007/0182194 A1 * 8/2007 Wood ..... B60P 1/435 296/62
2008/0029341 A1 * 2/2008 Cooper ..... E06C 7/423 182/107
2008/0150325 A1 6/2008 Seidel
2008/0301888 A1 12/2008 Watchorn et al.
2009/0038885 A1 * 2/2009 Ellement ..... B60R 3/02 182/97
2009/0065301 A1 * 3/2009 Ellement ..... B60R 3/02 182/127
2009/6065301 3/2009 Ellement
2010/0090517 A1 * 4/2010 Kramer ..... B60R 3/02 299/36.1
2012/0145480 A1 * 6/2012 Willis ..... E06C 5/06 182/106
2012/0205195 A1 * 8/2012 Tsutsumi ..... E02F 9/0833 182/106
2013/0048400 A1 * 2/2013 Holdener ..... B60R 3/02 180/89.1
2013/0092474 A1 * 4/2013 Magnussen ..... E06C 5/36 182/127
2013/0118832 A1 * 5/2013 Hedley ..... E06C 5/02 182/106
2013/0285573 A1 10/2013 Paterson
2014/0174852 A1 6/2014 Kim et al.
2015/0051409 A1 2/2015 Kriegbaum
2015/0136523 A1 * 5/2015 Madera ..... E06C 5/04 182/113

FOREIGN PATENT DOCUMENTS

WO WO9840241 9/1998
WO WO2015051409 4/2015

* cited by examiner

POWERED LADDER FOR LARGE INDUSTRIAL VEHICLES

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

This invention relates generally to large industrial vehicles and more particularly to a hydraulically ladder for facilitating the ability of a machine operator to reach the operator's station.

II. Discussion of the Prior Art

Large work vehicles used in earth moving and mining operations and other construction industries, such as dozers, drag lines, excavators, forest machines, mining shovels, trucks for hauling ore, etc, are characterized by having an operator's station or cab that is elevated several feet, sometimes as much as 20 feet, above ground level. Such equipment often includes one or more fixed ladders for allowing a worker to more readily mount the equipment. Power lifts have also been devised, one such lift being shown in the Rivinius U.S. Pat. No. 4,217,971. This patent shows a cage or basket at one end of a pair of hydraulically actuated arms that are designed to lift and also rotate the cage carrying the operator from ground level to a location closely adjacent a deck or walkway located immediately below the operator's station. From the deck, the operator may easily enter his or her work station.

Similarly, the Hemisen U.S. Pat. No. 3,656,578 shows a work vehicle of the type described on which a ladder is pivotally mounted such that it can be manually swung from a vertical orientation used when mounting the vehicle to a horizontal, stowed position that forms a guardrail that blocks exit of a worker from the work station. For a ladder built to withstand the forces and environment encountered in mining and other earth-moving applications, it is somewhat of a challenge to move the ladder from its vertical use position to its horizontal stowed position.

It is therefore an object of this invention to provide a hydraulically actuated ladder capable of deploying the ladder from a stowed position lying underneath and parallel to the vehicle's horizontal deck to a vertical use position where the ladder's bottom end is adjacent the ground and its upper end rests against the outer edge of the vehicle's deck. In the stowed position, it is completely out of the way and not an obstacle to a worker's ability to traverse the deck.

SUMMARY OF THE INVENTION

The present invention comprises an apparatus for providing access to an operator's station of a large mobile work vehicle. It includes a frame member adapted to be attached to a side surface of the work vehicle at a location immediately below the operator's work station, where the frame member supports a horizontally disposed deck surface. Located below the deck surface and affixed to the frame is a support structure to which a yoke member is pivotally joined to allow the yoke member to swing about a vertical axis. A ladder having a pair of stringers maintained in parallel, spaced relation by a plurality of spaced-apart tread members has first ends of the pair of stringers pivotally joined to the yoke member for rotation about a horizontal axis. A mechanical actuator is operatively coupled between one of the pair of stringers and the yoke. A linkage having first and second ends is installed with the first end being pivotally affixed to the support structure for rotation about a vertical axis and a second end of the linkage coupled to the other of the pair of stringers, i.e., the stringer that does not have the mechanical actuator coupled to it. An electric motor is operatively coupled to the mechanical actuator whereby actuation of the electric motor moves the mechanical actuator in a first direction to displace the ladder from a stowed position immediately below and parallel to the deck surface to a use position where the ladder extends from adjacent the ground to the deck surface. The above-mentioned linkage is preferably a turnbuckle whose length can be readily adjusted so as to control the locus of travel of the ladder in moving between its stowed position and its use position.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
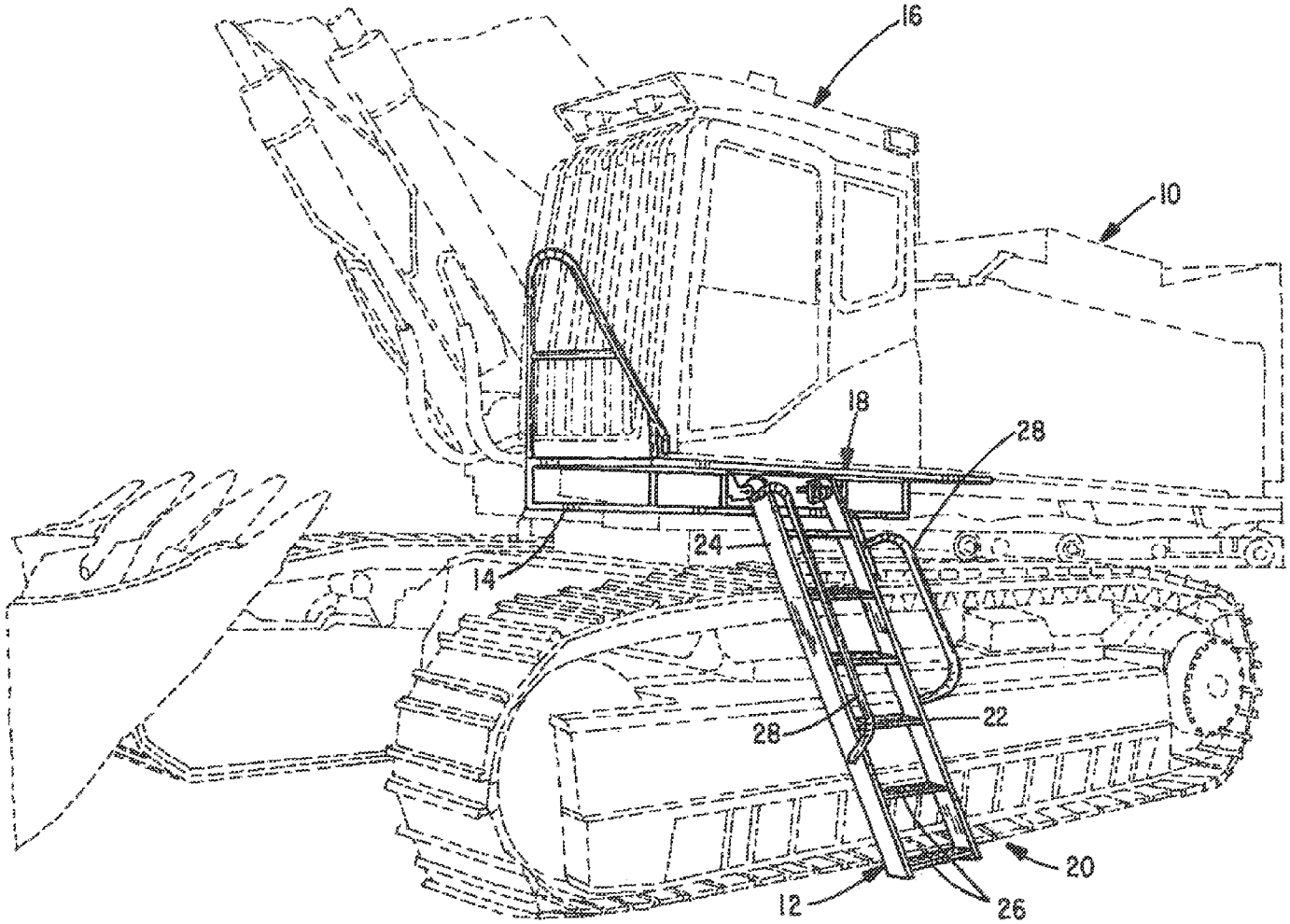
FIG. 1 is a perspective view of a typical large industrial vehicle incorporating the powered ladder assembly of the present invention.

This description of the preferred embodiments is intended to be read in connection with the accompanying drawings, which are to be considered part of the entire written description of this invention. In the description, relative terms such as "lower", "upper", "horizontal", "vertical", "above", "below", "up", "down", "top" and "bottom" as well as derivatives thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another structure or surface or integrally fabricated in one piece, unless expressively described otherwise.

Referring first to FIG. 1, there is shown a typical large work vehicle, here shown as a power shovel 10 with the powered ladder assembly of the present invention 12 joined to it. The powered ladder assembly includes a frame 14 that is adapted to be attached to the vehicle 10 at a location slightly below an operator's work station or cab 16. The frame 14 supports deck plates (not shown) on it upper surface 18 providing a platform on which the operator may stand and walk. While FIG. 1 shows a typical work vehicle in the form of a power shovel, those skilled in the art will appreciate that the ladder assembly 12 of the present invention may find use with any number of large work vehicles including, but not limited to, dozers, drag lines, excavators, mining ore trucks, etc., where the operator's work station 16 is at a height making it difficult for an operator to reach from a position on the ground. The frame 14 may be affixed to the vehicle in any suitable way, including bolts or a more permanent attachment by welding.

The powered ladder assembly 12 is seen to comprise a ladder 20 having a pair of stringers 22 and 24 maintained in parallel, spaced relation by a plurality of spaced-apart tread members 26. Hand railings, as at 28, are affixed to the stringers to provide for safer ascent and descent of the operator to and from the work vehicle.

Figure 4:
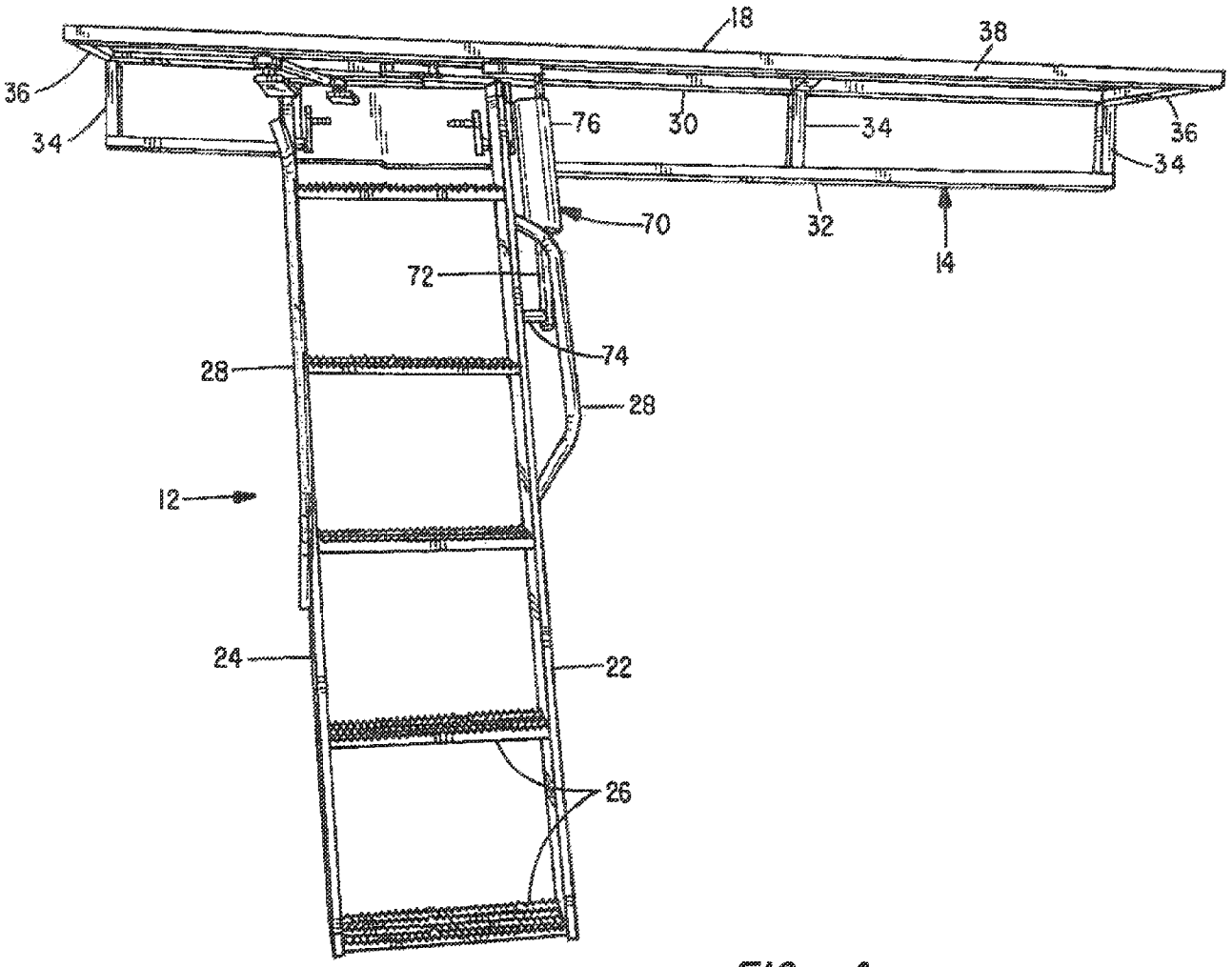
FIG. 4 is a front view of the powered ladder assembly with the ladder in its use position.

Referring momentarily to FIG. 4, the frame 14 is seen to comprise an elongated vertical portion comprising first and second horizontally extending steel bars or tubes 30 and 32 maintained in parallel, spaced relation by a plurality of vertical struts 34. Welded to the elongated horizontal bar or tube 30 is a platform or deck 18 that is cantilevered outwardly by horizontal struts 36. Welded to the outer ends of the horizontal struts 36 is a front rail 38. As previously mentioned, affixed to the upper surfaces of the rails 30 and 38 and further supported by the horizontal struts 36 is one or more sheets of steel that preferably have a rough surface that provides a walkway for an operator. Expanded metal sheets (not shown) are preferable in that they permit dirt and debris that may be carried by the operator's shoes to fall back down to the ground.

Figure 5:
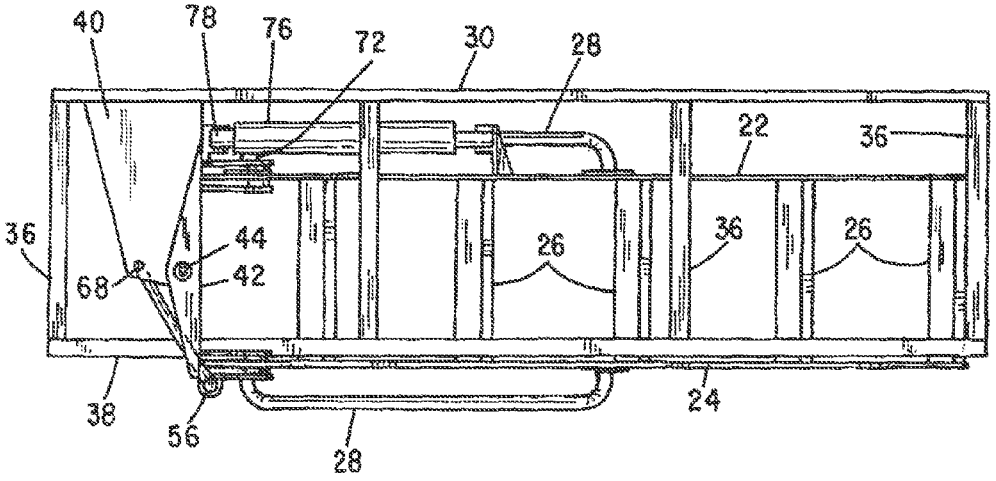
FIG. 5 is a bottom view of the powered ladder assembly with the ladder in its stowed position.

Referring next to FIG. 5, welded in place beneath the deck, but within the confines of the frame structure, is a support structure 40 to which a yoke member 42 is pivotally joined for rotation about a vertical axis 44 (FIG. 5). More particularly, and as seen in FIG. 2, the yoke 42 includes a cylindrical sleeve bearing 46 in which a pivot pin resides where the ends of the pivot pin are joined to the support member along the axis 44.

Figure 6:
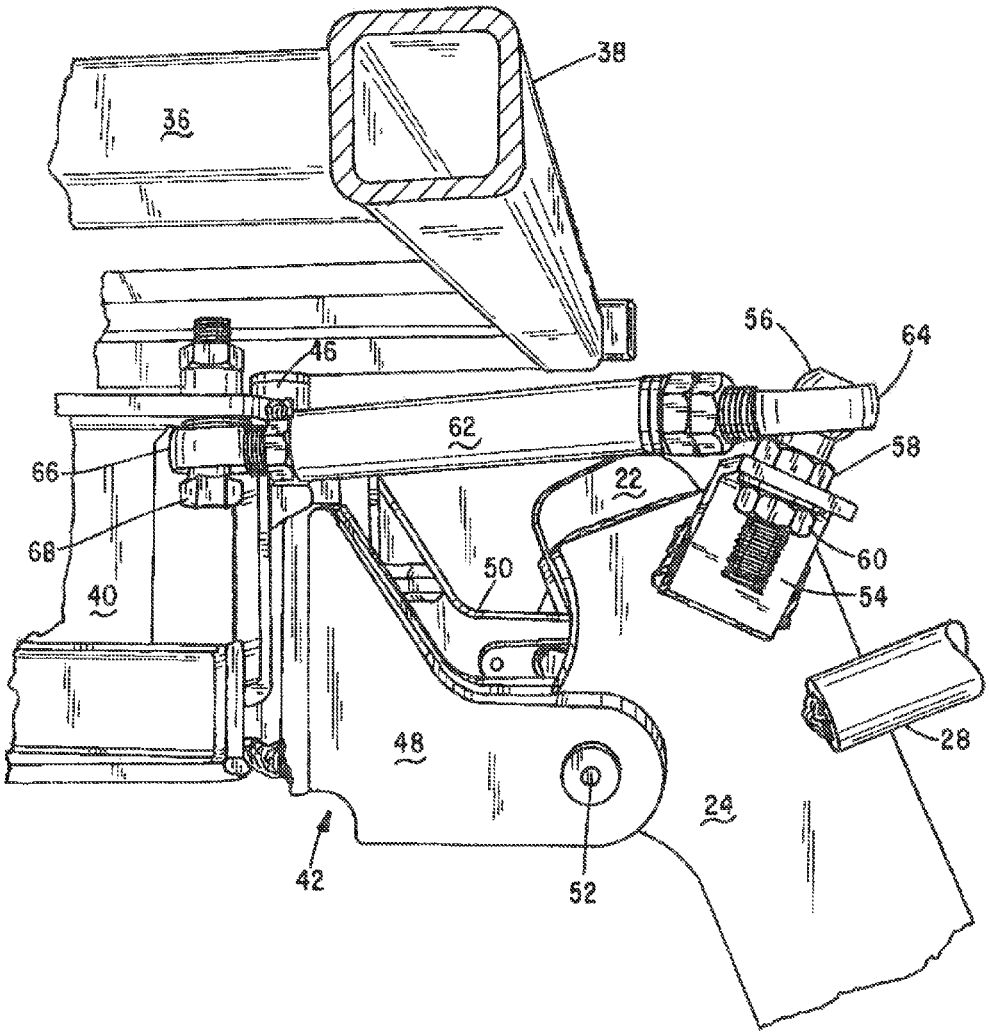
FIG. 6 is a partial and enlarged view of the connections of the ladder to its support structure with the ladder in its use position.

As shown in FIG. 6, the yoke 42 has a pair of arms 48 and 50 that are pivotally joined to the opposed ladder stringers 22 and 24 allowing the ladder 12 to rotate about a horizontal axis passing through the pivot joints as at 52, welded to the ladder stringer 24 proximate its upper end is a Z-shaped bracket 54 to which a ball joint member 56 is secured by threaded nuts 56 and 60. A linkage 62, shown in FIG. 6 as a turnbuckle, has a first end 64 forming part of the ball joint and its opposite end 65 pivotally joined to the support member 40 by a shoulder bolt 68 so as to form a swivel joint.

As seen in FIGS. 4 and 5, a mechanical actuator means, here shown as a hydraulic cylinder 70, has its piston rod 72 pivotally joined by a pin 74 to the ladder stringer 22 and its cylinder barrel 76 pivotally joined at 78 (FIG. 5) to the arm 50 (FIG. 6) of the yoke 42. The horizontal displacement between the pivot joint 74 and the pivot joint 78 constitutes a lever arm such that actuation of the hydraulic cylinder 70 can be made to either lift or lower the ladder assembly 12 between its use and stowed positions. While the mechanical actuator is here shown as a hydraulic cylinder, those skilled in the art will recognize that a variety of other devices such as a rotary actuator, a winch and cable, a motor driven lead screw may be substituted.

Figure 2:
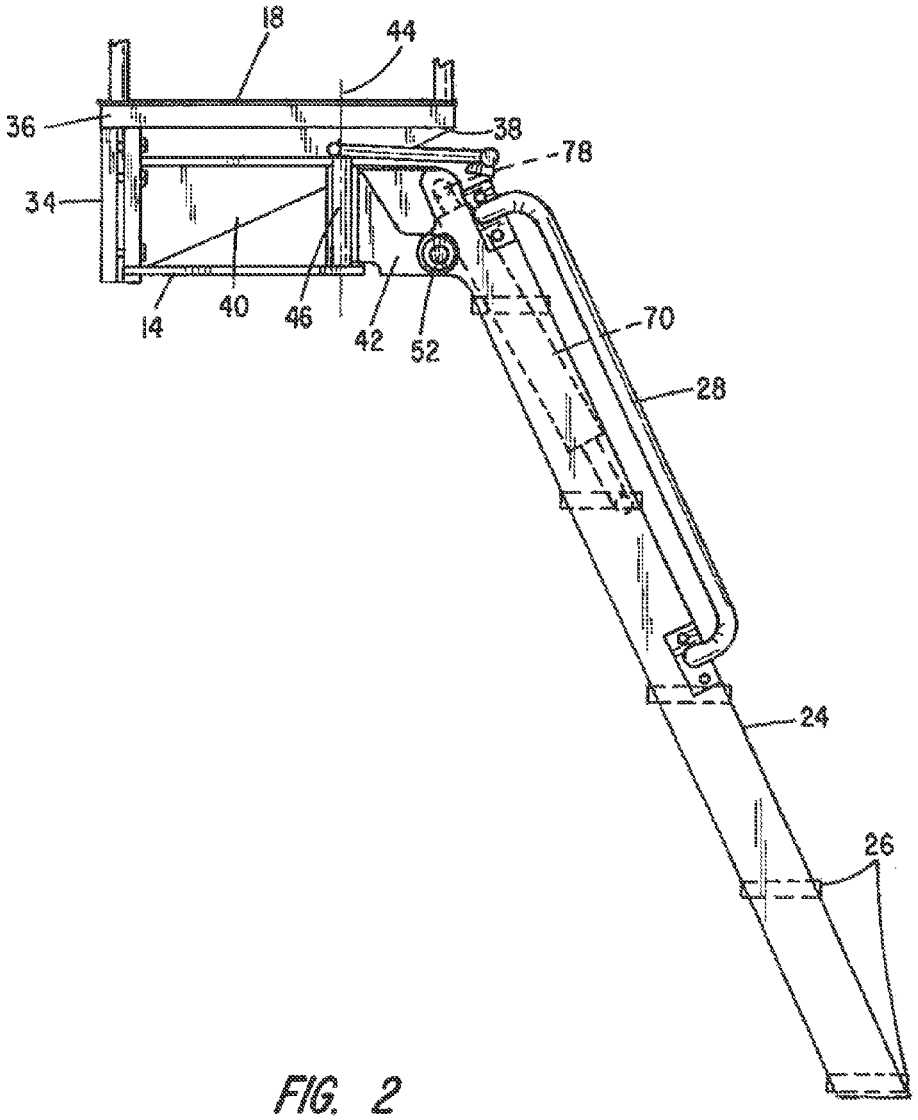
FIG. 2 is a left side view of the powered ladder assembly removed from the vehicle and with the ladder in its use or deployed position.
Figure 3:
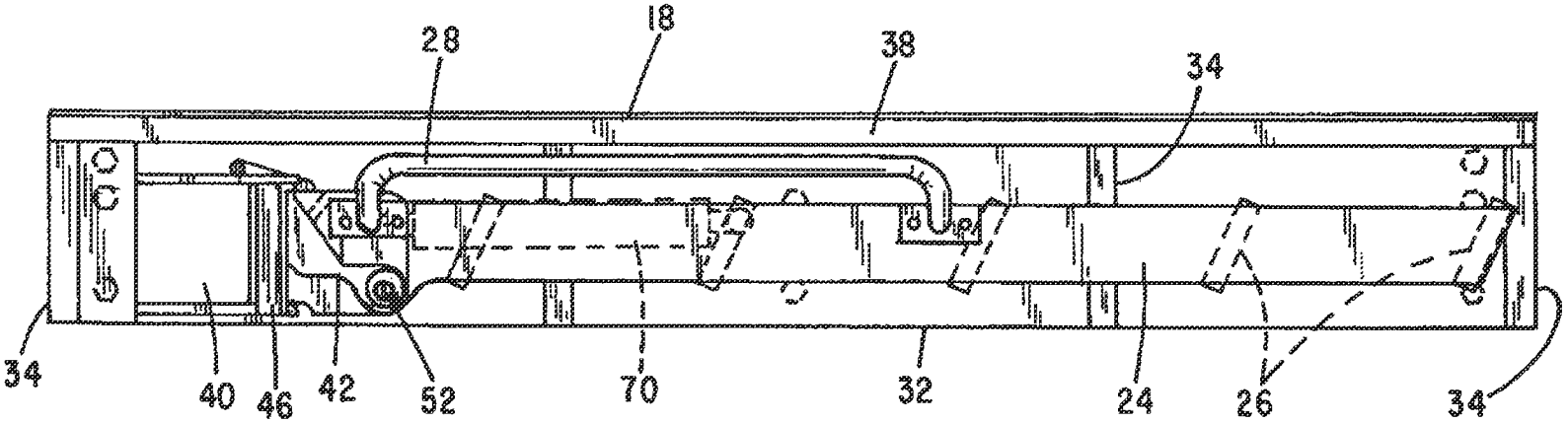
FIG. 3 is a front view of the powered ladder assembly with the ladder in its stowed position.

Assuming that the ladder is in its use position, as shown in FIGS. 2 and 4, when the cylinder 70 is actuated to draw the piston rod 72 back into the cylinder barrel 76, as the ladder elevates, a compression force will be applied to the linkage turnbuckle 62 to also cause the yoke 48 carrying the ladder to pivot about the vertical axis 44 of the bearing 46 causing the ladder to simultaneously rotate counterclockwise when viewed in FIG. 4. By proper adjustment of the length of the turnbuckle linkage 62, the ladder can be made to come to rest in its stowed disposition, shown in FIGS. 3 and 5, at a location beneath and parallel to the deck platform 18 where it is out of the way and therefore, does not form an obstacle to safe passage of a person walking atop the deck.

In deploying the ladder from its stowed disposition to its use position, just the opposite action occurs. As the piston rod 72 extends out from the cylinder barrel 76, the force exerted on the ladder by the piston, along with the resulting force acting on the turnbuckle linkage, results in movement of the ladder from its stowed disposition (shown in FIG. 5) to its deployed position (shown in FIGS. 1 and 4). As the ladder assembly is being lowered to its use position, the turnbuckle link 62 will be placed in tension. In that the movement of the linkage is constrained by its pivotal mounting, a force is exerted via the yoke to simultaneously cause the ladder to swing out from beneath the frame in a clockwise direction until the lower end of the ladder is adjacent the ground.

Figure 7:
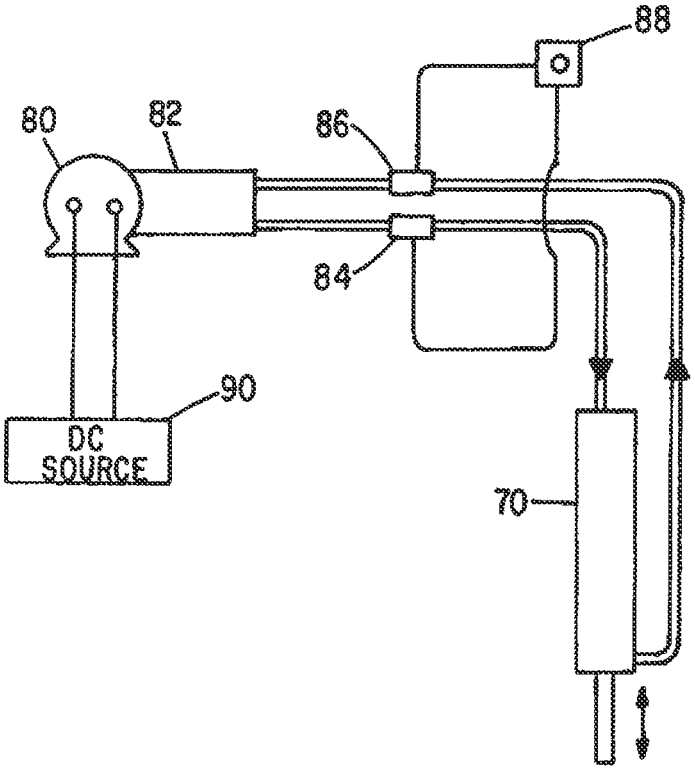
FIG. 7 is a schematic diagram of the hydraulic circuit for the powered ladder assembly.

FIG. 7 is a schematic diagram of the control for the hydraulic cylinder 70. It is seen to comprise an electrical motor 80 that is preferably connected a DC supply 90 which may be the battery of the large mobile work vehicle on which the ladder assembly of the present invention is attached. The motor 80 drives a hydraulic pump 82 that is connected by hydraulic lines to the cylinder 70 via solenoid valves 8 and 86, the electrical actuation of which is effected by the operator using a pushbutton or toggle switch 88.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices. Also, various modifications, both as to the equipment and operating procedures, can be accomplished without departing from the scope of the invention itself.

What is claimed is:

1. An apparatus for providing access to an operator's station of a large mobile work vehicle comprising:

(a) a frame member adapted to be attached to a side surface of the mobile work vehicle at a location immediately below the operator work station, the frame member supporting a horizontal disposed deck surface;

(b) a support structure affixed to the frame member below the deck surface;

(c) a yoke member pivotally joined to the support structure for rotation about a first vertical axis;

(d) a ladder having a pair of stringers maintained in parallel spaced relation by a plurality of spaced apart tread members and with first ends of the pair of stringers pivotally joined to the yoke member for rotation about a horizontal axis;

(e) a mechanical actuator operatively coupled between one stringer of the pair of stringers and the yoke member and adapted to reciprocally and selectively apply a lifting force and a lowering force to the ladder;

(f) a linkage having first and second ends, the first end of the linkage being pivotally affixed to the support structure for rotation about a second vertical axis and the second end of the linkage coupled by a ball joint to the other of the pair of stringers wherein the second vertical axis is different than the first vertical axis; and (g) an electric motor coupled to the mechanical actuator whereby actuation of the electric motor drives the mechanical actuator in a first direction to displace the ladder from a stowed position immediately below and parallel to the deck surface to a use position where the ladder extends from adjacent the ground to the deck surface.

2. The apparatus of claim 1 wherein the mechanical actuator comprises a hydraulic cylinder having one of a piston and a cylinder barrel pivotally coupled to one of the pair of stringers and the other of its piston and cylinder barrel pivotally coupled to the yoke member.

3. The apparatus of claim 2 and further including a hydraulic pump coupled to the hydraulic cylinder through flow control valves and where the hydraulic pump is driven by the electric motor.

4. The apparatus of claim 3 wherein actuation of one of the control valves moves the ladder from the use position to the stowed position and actuation of another of the control valves moves the ladder from the stowed position to the use position.

5. The apparatus of claim 4 wherein the linkage comprises an adjustable length turnbuckle.

6. The apparatus of claim 1 wherein the ladder extends toward the deck surface at an inclined angle when in the use position.

7. The apparatus of claim 1 and further including hand railings affixed to each of the pair of stringers.

8. The apparatus of claim 7 where one of the hand railings is disposed beneath the deck and the other of the hand railings straddles an outer edge of the deck surface when the ladder is in its stowed position.

* * * * *